US011833577B2

(12) United States Patent
Horton

(10) Patent No.: US 11,833,577 B2
(45) Date of Patent: Dec. 5, 2023

(54) MUSHROOMING EXPANDABLE FASTENER INSTALLATION TOOL AND METHODS

(71) Applicant: Scott Horton, Las Vegas, NV (US)

(72) Inventor: Scott Horton, Las Vegas, NV (US)

( * ) Notice: Subject to any disclaimer, the term of this patent is extended or adjusted under 35 U.S.C. 154(b) by 0 days.

(21) Appl. No.: 17/176,941

(22) Filed: Feb. 16, 2021

(65) Prior Publication Data

US 2022/0258226 A1 Aug. 18, 2022

(51) Int. Cl.
*B21J 15/10* (2006.01)
*B21J 15/04* (2006.01)

(52) U.S. Cl.
CPC ..... *B21J 15/105* (2013.01); *B21J 15/04* (2013.01)

(58) Field of Classification Search
CPC ..... B21J 15/105; B21J 15/04; F16B 13/06
See application file for complete search history.

(56) References Cited

U.S. PATENT DOCUMENTS 3,667,340 A 6/1972 Black et al.
5,313,680 A * 5/1994 Ringler ..... B25B 21/007 7/138
5,666,710 A * 9/1997 Weber ..... B21J 15/105 227/2
6,935,821 B2 8/2005 Bodin et al.
7,296,499 B2 11/2007 Bodin et al.
7,494,310 B1 2/2009 Boding et al.
2003/0190211 A1* 10/2003 Bodin ..... F16B 35/06 411/29
2004/0231467 A1* 11/2004 Hufnagl ..... F16B 23/0061 81/55
2009/0302088 A1* 12/2009 Santamarina ..... B25B 31/00 227/139
2019/0022835 A1* 1/2019 Chen ..... B25B 23/12
2019/0162217 A1* 5/2019 Vovan ..... B23P 19/062
2019/0283109 A1* 9/2019 Leger ..... B25B 27/0007
2020/0164491 A1* 5/2020 Flory ..... B25B 23/0007

OTHER PUBLICATIONS

Proto Deep thin wall impact sockets, The Stanley Works, available at https://www.protoindustrial.com/literatures/Brand/Proto/T20510_Proto%20Deep%20Thin%20Wall%20Impact%20Sockets.pdf (Year: 2005).*

(Continued)

*Primary Examiner* — Kyle A Cook
(74) *Attorney, Agent, or Firm* — Parsons & Goltry, PLLC; Michael W. Goltry; Robert A. Parsons

(57) ABSTRACT

Methods, systems and tools for securing to a panel an expandable fastener having a threaded component and a mushrooming component, the tool including a sleeve having a cylindrical body with a hollow inside portion and an internal spline configured to match a splined shoulder of the mushrooming component, a drive shaft having a driving portion configured to engage and rotate the threaded component, the driving portion positioned within the hollow portion of the sleeve, and a driven portion configured to be driven by an arbor, the arbor having a first shaft portion configured to engage with the driven portion and drive the drive shaft, and a second shaft portion configured to connect to a drill or nut driver to drive the drive shaft to turn the threaded component relative to the mushrooming component and collapse the mushrooming component.

20 Claims, 7 Drawing Sheets

(56) References Cited

OTHER PUBLICATIONS

ITW Construction Products, Sammy X-Press It Installation Tool, 5 photos of item in public use in the United States prior to Feb. 16, 2021.

ITW Construction Products, image of item in public use in the United States prior to Feb. 16, 2021, https://www.toolup.com/ITW-Buildex-8194910-XPIT-Sammy-X-Press-Installation-Tool?CATARGETID=120204890000550598&CADevice=c&gclid=EAlalQobChMI5tzlqo2h7wIVjYbACh1MDgeDEAQYAyABEglwRPD_BwE, 1 page, United States.

ITW Construction Products, Sammy X-Press, sales data sheet, 5 pages, items in public use in the United States prior to Feb. 16, 2021, www.toolbarn.com > sammy_x-press_anchor_data_sheet, United States.

ITW Builder, Sammy Xpress It, Installation Tool Kit for Sammy X-Press Anchors, Part No. 8194910, 1 photo of device package, 9 photos of device, 2 sheets of representative drawings; device was in public use prior to Feb. 16, 2021, USA.

* cited by examiner

MUSHROOMING EXPANDABLE FASTENER INSTALLATION TOOL AND METHODS

BACKGROUND OF THE INVENTION

1. Field of the Invention

The present invention relates to tools for use with mushrooming expandable fasteners or rivets and related systems and methods.

2. Background Information

Mushrooming expandable fasteners or rivets are used for securing panels together and/or attaching components to panels. Hex-drive rivets, also know as fab-lok or FAB-LOK® fasteners, consist of a sleeved screw with a hex-washer head. The sleeve fans out when installed on a back side of a panel to secure the fastener to the panel and to resist vibration, expansion, and contraction. Fasteners install with a wrench and socket and require access to only one side of the panel or material. A common type of mushrooming fastener is the FAB-LOK fastener for which a patent was granted in 1972, particularly U.S. Pat. No. 3,667,340. Such fasteners or rivets maintain panel integrity in high-stress environments, including in high wind areas, expansion and contraction situations, severe vibration locations (whether inside or outside a building), and racking and the repair of oversized holes.

A typical FAB-LOK® type of fastener is shown in FIG. 1, FIG. 2 and FIG. 3. The fastener 20 includes a threaded component 22 and a mushrooming component 24. The threaded component 22 or screw includes a hex-head 23 and a shank with threads 29. Typically the hex-head 23 receives and is turned by a 5/16 hex wrench, socket or nut driver. The mushrooming component 24 includes a threaded sleeve 25 which mates with the threads 29 of the threaded component 22. The mushrooming component 24 also includes expanding or mushrooming sleeves 26, 26 (commonly 4 separate sleeves 26) through which passes the threaded shank of the threaded component 22. The mushrooming component also includes a shoulder 27. The mushrooming sleeves 26 are typically integrally connected to and between the threaded sleeve 25 and shoulder 27 and are configured to bend when the threaded sleeve 25 travels toward the shoulder 27. The shoulder 27 typically includes a splined holding-surface 28 having a 12-point splined surface. The shoulder 27 is configured to receive and be held in place by a corresponding wrench or socket.

FIG. 3 and FIG. 4 demonstrate how fastener 20 is typically installed. In one application a drill sleeve 12 is securely fastened to a drill 10. The drill sleeve 12 does not rotate when the drill 10 is activated. At an outer end of drill sleeve 12 is fastened a drill socket 14 configured with a 12-point splined socket to receive, and hold in place, the shoulder 27 of fastener 20. A nut driver 16, such as a 5/16 inch nut driver, is secured in the chuck of the drill 10 and rotates in usual manner. The nut driver 16 is configured to engage and drive the head 23 of threaded component 22 to activate the threads 29 which in turn draw the threaded sleeve 25 toward the shoulder 27 to mushroom or collapse the sleeves 26. The collapsed sleeves 26 firmly secure the fastener to the panel 18. In this manner another panel or component part 17 may also be secured to panel 18. Such other components may include struts 15 or conduit pipe hangers, other panels or other components as desired.

To affix fastener 20 to a panel 18 (as in FIG. 3) fastener 20 is inserted into a predrilled hole (typically using a 5/16 inch drill bit to create a hole within a steel or metal panel, for instance). The drill sleeve 12 is positioned upon the fastener and particularly to hold the shoulder 27 stationary while turning the head 23 of the fastener 20 to retract or "mushroom" the sleeves 26 at the backside 19 of the panel 18. The drill sleeve 12 secures the shoulder 27 of the mushrooming component 24 of the fastener 20 while the drill 10 or other tool turns the hex head 23 of a threaded screw 22 passing through the hole and about which the mushrooming sleeves 26 are threaded as described generally in U.S. Pat. No. 3,667,340. While such drill sleeve 12 allows for securing a fastener 20 in conjunction with a drill or screw-gun, there is room for improvement.

FIG. 5 and FIG. 6 depict a typical component to be fastened to a panel 18 or other surface. In one aspect, a strut 13 having a generally U-shaped cross-section with spaced slots or holes is to be fastened to a panel. Due to the configuration of the strut 13, the drill sleeve 12 is unable to be used, particularly where strut 13 is a 1⅝ inch Unistrut commonly used in construction. For instance, a 1⅝ inch strut 13 typically has an insert opening 15 of less than one inch, and typically about ⅞ inches. The diameter of drill sleeve 12 is much greater than ⅞ inches, and is typically about 1½ inches and unable to be inserted into strut 13 in order to secure fastener 20. Such drill sleeves 12 are also too wide and do not work for securing standard conduit pipe clamps, hangers and other components. Thus, when a worker desires to fasten a strut 13 or component to a panel 18, the worker typically must use two or three separate tools. For instance, a first tool is used to drill a 3/16 inch hole. Then, while the worker holds the strut 13 or conduit connector in place so the slot or hole of the connector aligns with the drilled hole, the worker inserts fastener 20 through the opening 15, through the hole in the strut 13, and into the drilled hole. At the same time the worker must use a second tool, such as a box wrench, to hold the shoulder 27 in place while positioning a third tool, such as a 5/16 inch nut driver upon the head 23 to rotate the head 23 to mushroom the sleeves 26. Positioning a box wrench or vice grip or other tool to hold the shoulder 27 stationary is difficult and time consuming. Often a strut 13 or other component is to be positioned high upon a panel wall or ceiling, so doing so may also require the worker to stand on a ladder while using the two or three tools (in addition to holding the strut and fasteners) and undertaking the drilling, holding and fastening as described above. Positioning a box wrench within the opening 15 of the strut 13 is difficult and often results in scrapping or pinching of fingers or the knuckles or hands of the worker. Such fastening is often frustrating and labor intensive, and expensive in terms of labor costs and requirement to obtain and maintain multiple tools.

There are other types of mushrooming fasteners and devices which are used in different applications such as in the pipe handling trades, for instance, to provide direct attachment of a threaded rod into a metal deck. A Sammy X-Press® System includes a threaded anchor and expandable sleeve. Expanding anchoring strips of the anchor collapse at the back side of a panel to prevent pullout after installation of the anchor. A female thread in the frontside of the anchor receives a threaded rod for hanging components from a panel, for instance. An installation tool is used to install the anchors. Such pipe-anchor and installation tool are described in U.S. Pat. Nos. 6,935,821, 7,296,499, and 7,493,210. While these anchors and tools have benefits for hanging pipe, they are not compatible with a fastener 20 of the type described above, or in applications where such fasteners are desired or required. The drill sleeve 12 for use with a fastener 20, and the Sammy X-Press tools and fasteners have been available for decades; however, there has been a long-standing unawareness or lack of appreciation of the problems presented (or opportunities missed) by these devices or systems and a great and longstanding need for improvement. Workers or users of these tools or systems may believe the difficulties of the tools are just another part of the job, not appreciating or considering there may be better solutions.

SUMMARY OF THE INVENTION

Heretofore, having to take steps to use the sleeve 12 in conjunction with holding a box wrench within the channel of a strut 13, for instance, and not being able to insert the sleeve 12 into the channel of a typical strut, has been considered by workers and others as simply part of the job when using mushrooming types of fasteners, and/or workers or others have not appreciated that there are better ways. Applicant, however, has recognized these and other problems and presents a solution of utilizing the tools, systems and methods noted herein.

The invention pertains to a tool for use with an expandable fastener having a threaded component and a mushrooming component. In one aspect the tool turns a 5/16 inch hex head screw of a fab-lock type of fastener while simultaneously holding or retaining in place a 5/8 inch shoulder of the fab-lock mushrooming expandable fastener to collapse the mushrooming component. The tool includes a sleeve having a cylindrical body with a hollow inside diameter portion and an internal socket configured to match a shoulder of the mushrooming component, a drive shaft having a driving portion configured to engage and rotate the threaded component, the driving portion positioned within the hollow inside diameter portion of the sleeve, and a driven portion configured to be driven by an arbor, and an arbor having a first shaft portion configured to engage with the driven portion and drive the drive shaft, and a second shaft portion configured to connect to a drill or nut driver to drive the drive shaft to turn the threaded component relative to the mushrooming component and collapse the mushrooming component. In one aspect the internal socket of the sleeve is a 12-sided socket configured to mesh with the shoulder of a FAB-LOK type of fastener. The socket may include a 12-sided splined surface. In aspects the socket of the sleeve is a corresponding internally splined structure including 12 separate splines which match the splines of the shoulder of the fastener. In further aspects the tool is configured to operate collapse of different-sized mushrooming fasteners.

In a further aspect the invention includes an installation tool for use with an expandable fastener having a threaded component and a mushrooming component, the tool including a sleeve having a cylindrical body with a hollow inside diameter portion and a socket configured to match a shoulder of the mushrooming component, a drive shaft having a driving portion having a socket configured to engage and rotate a head of the threaded component, the driving portion positioned within the hollow inside diameter portion of the sleeve, and a driven portion configured to be driven by an arbor, the driving portion having a maximum outer diameter and the driven portion having a maximum outer diameter, the maximum outer diameter of the driven portion being greater than the maximum outer diameter of the driving portion, and an arbor having a first shaft portion configured to engage with and drive the driven portion and drive the drive shaft, and a second shaft portion configured to connect to a drill or nut driver to drive the drive shaft to turn the threaded component relative to the mushrooming component and collapse the mushrooming component. In aspect the socket is a 12-sided socket, and in further aspects the socket is a splined socket.

In further aspects, the invention includes an installation tool for use with an expandable fastener having a threaded component and a mushrooming component, the threaded component having a 5/16 inch hex head and the mushrooming component having a 12-point externally splined shoulder, the tool including a sleeve having a cylindrical body with a hollow inside diameter portion and a socket configured to match the splined shoulder of the fastener, a drive shaft having a driving portion having a socket configured to engage and rotate the hex-head of the fastener, the driving portion positioned within the hollow inside diameter portion of the sleeve, and a driven portion configured to be driven by an arbor, and an arbor having a first hex shaft portion configured to engage with the driven portion and drive the drive shaft, and a second hex shaft portion configured to connect to a drill or nut driver to drive the drive shaft to turn the threaded component relative to the mushrooming component and collapse the mushrooming component, the arbor configured to receive a drill bit while the arbor is simultaneously retained within the drill or nut driver.

Further aspects include a system to install a mushrooming expandable fastener utilizing the tool addressed herein together with an expandable fastener having a 12-point (or 12-sided) externally splined shoulder, the splined shoulder complementary to the socket of the tool. The splined shoulder mates with or meshes into the socket or the splined region of the tool.

Further aspects include methods of installing an expandable fastener utilizing the tools described herein, in one aspect the tool holding a shoulder of the fastener while turning a head of the fastener to collapse a mushrooming component of the fastener. In one aspect the method includes collapsing the mushrooming sleeves of a FAB-LOK type of fastener. In aspects the method includes spinning a 5/16 inch head of a fastener while holding a 5/8 shoulder of the mushrooming fastener by using the tools described herein.

The above partial summary of the present invention is not intended to describe each illustrated embodiment, aspect, or every implementation of the present invention. The figures and detailed description and claims that follow more particularly exemplify these and other embodiments and further aspects of the invention.

BRIEF DESCRIPTION OF THE DRAWINGS

Some features of the invention are represented by the accompanied drawings. These drawings capture the major defining features of the invention but are not intended to encompass every variation.

DETAILED DESCRIPTION OF THE INVENTION

Figure 1:
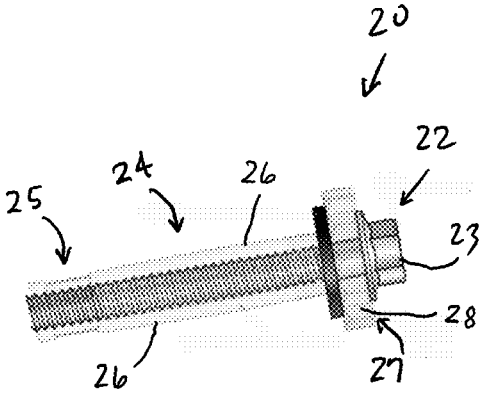
FIG. 1 (Prior Art)
FIG. 1 is a perspective view of a prior art fastener for use with the present invention and with portions shown in cut-away.
Figure 3:
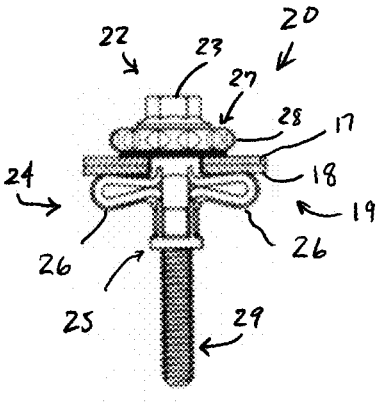
FIG. 3 (Prior Art)
FIG. 3 is a side view of the fastener of FIG. 1 in a representative installation mode.
Figure 2:
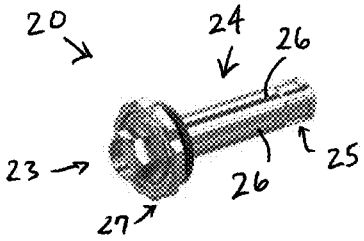
FiG. 2 (Prior Art)
FIG. 2 is a perspective view of the prior art fastener of FIG. 1.
Figure 4:
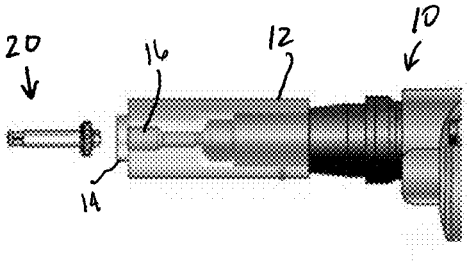
FIG. 4 (Prior Art)
FIG. 4 is a partial side view of the fastener of FIG. 1 in a representative installation mode with portions shown in cut-away.
Figure 5:
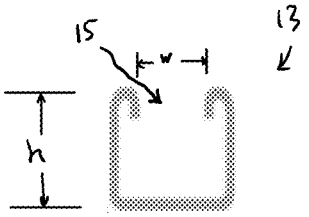
FIG. 5 (Prior Art)
FIG. 5 is a side view of a prior art component for use in conjunction with the present invention.
Figure 6:
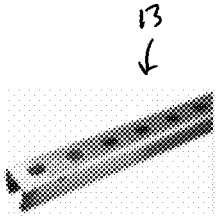
FIG. 6 (Prior Art)
FIG. 6 is a perspective view of the prior art component of FIG. 5.
Figure 7:
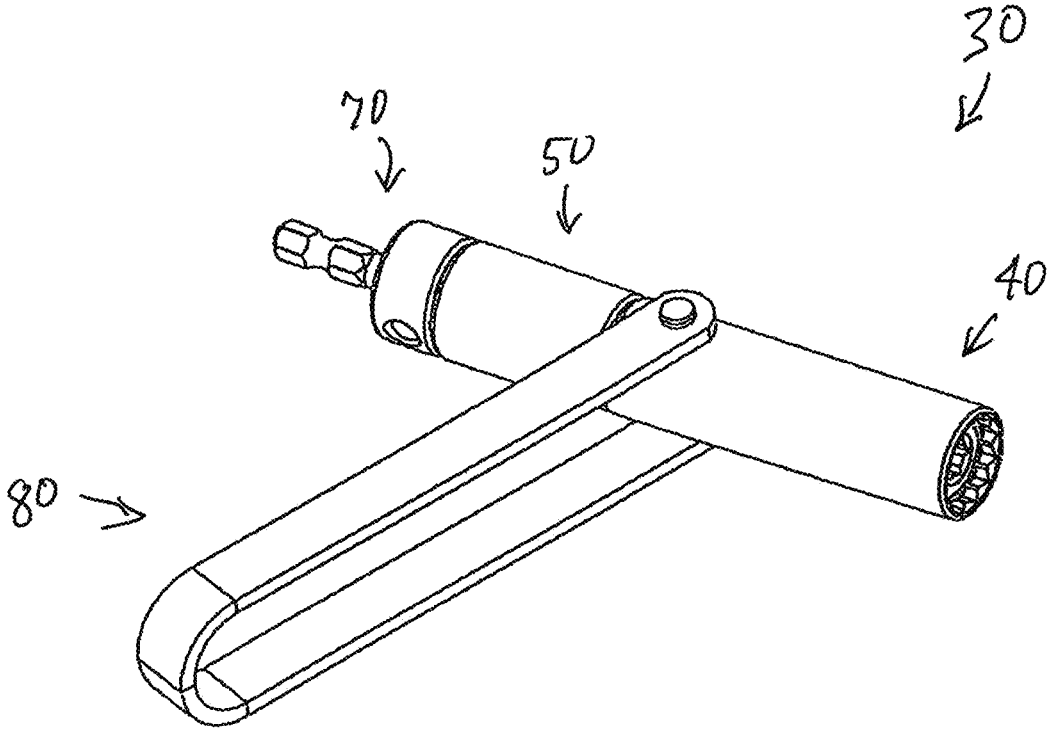
FIG. 7 is a perspective view of a tool in accordance with one aspect of the present invention and including an optional handle component.

Referring to FIGS. 7-18, aspects of the tools, systems and methods of installing a fab-lock fastener 20 in accordance with the present invention are presented. FIG. 7 is a perspective view of tool 30 which in one aspect is made of metal such as steel. Tool 30 may be made of other materials. Tool 30 includes a tool sleeve 40, drive shaft 50 and arbor 70. In further aspects tool 30 may include a handle 80 and a drill bit 90. Tool 30 is used to secure fasteners of the FAB-LOCK® fastener variety to panels in order to secure panels together or secure components to the panels. Tool 30 may be used to secure fasteners 20 as shown in FIGS. 1-3, for instance. Tool 30 in one aspect is used to secure fastener 20 to a panel 18 (FIG. 3). Sleeve 40 is placed upon and holds shoulder 27 of the faster 20 while drive shaft 50 is placed upon and rotates the head 23 of the fastener 20, thus collapsing sleeves 26 of the fastener 20 to secure the fastener 20 to panel 18 as shown in FIG. 3. The arbor 70 inserts into a drill 10 (or other spinning device such as a nut driver). Arbor 70 is connected to drive shaft 50 to spin the head 23. A handle 80 connected to sleeve 40 is grasped by a worker to hold sleeve 40 in relatively fixed position so that sleeve 40 does not or only minimally rotates in order to hold shoulder 27 in position while drive shaft turns head 23. As head 23 is turned while shoulder 27 is maintained stationary, the sleeves 26 of fastener 20 mushroom to secure the fastener 20 to the panel 18. In some cases the fastener 20 secures a panel 18 to a component or other panel 17, or secures a component 17 to a panel 18, for instance.

Figure 8:
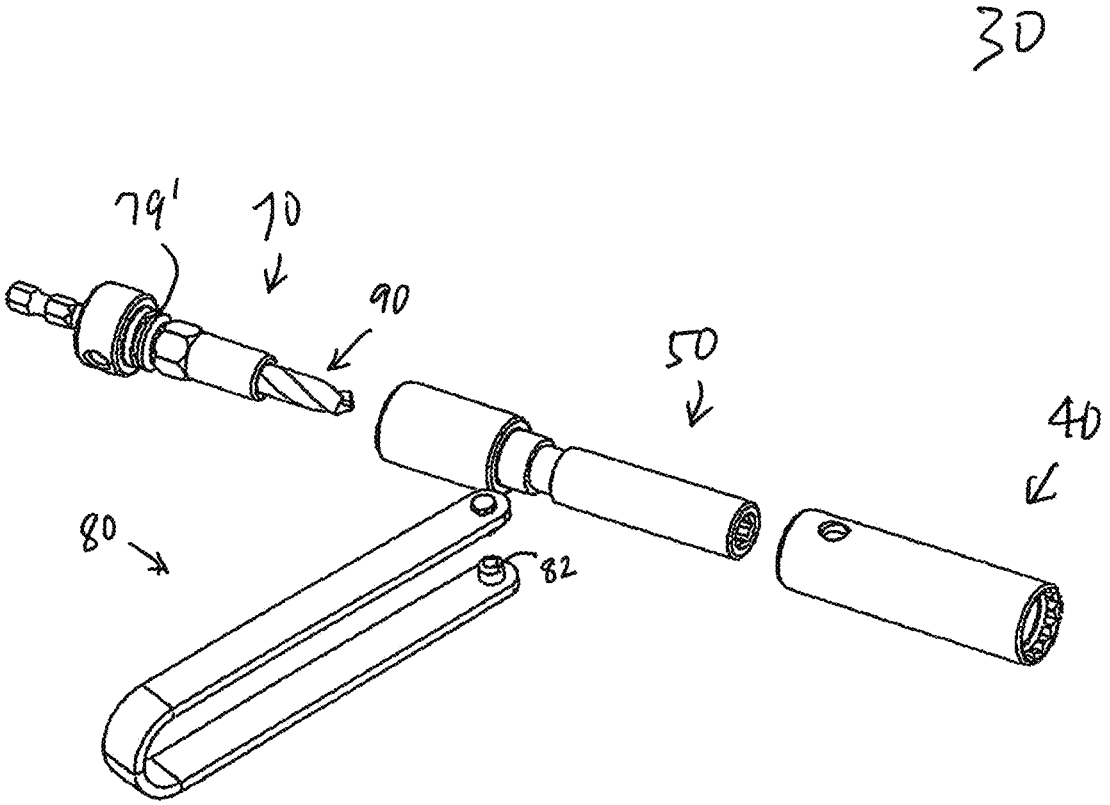
FIG. 8 is an exploded view of the tool of FIG. 7 and including an optional drill bit component.

FIG. 8 shows tool 30 in exploded view and depicts how arbor 70 inserts into drive shaft 50 and how drive shaft 50 inserts into sleeve 40. Handle 80 secures into handle ports 48 of sleeve 40, securing drive shaft 50 within sleeve 40.

Figure 9:
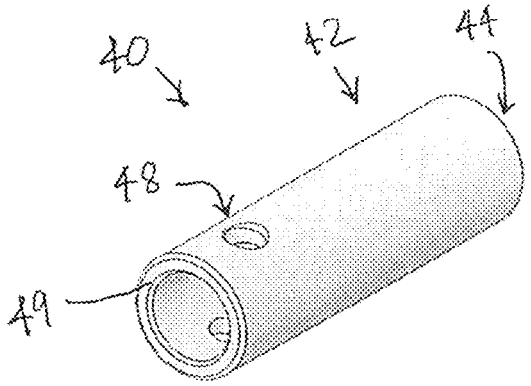
FIG. 9 is a perspective view of a component in accordance with one aspect of the tool of FIG. 7.
Figure 10:
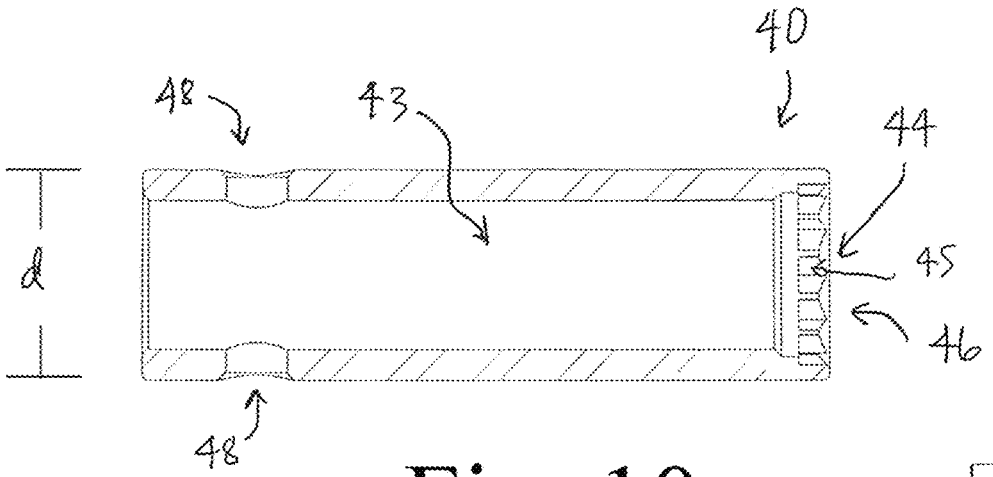
FIG. 10 is a section view taken along line 10-10 of FIG. 11.
Figure 11:
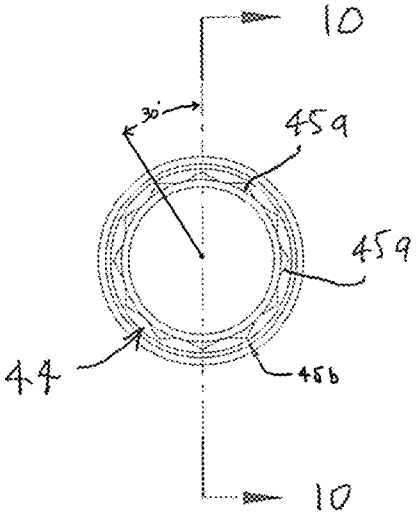
FIG. 11 is an end view of the component of FIG. 9.
Figure 14:
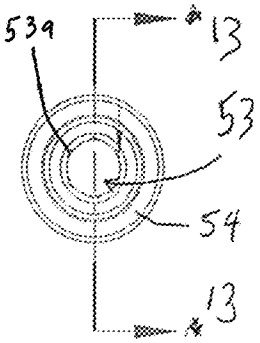
FIG. 14 is an end view of the component of FIG. 12.
Figure 13:
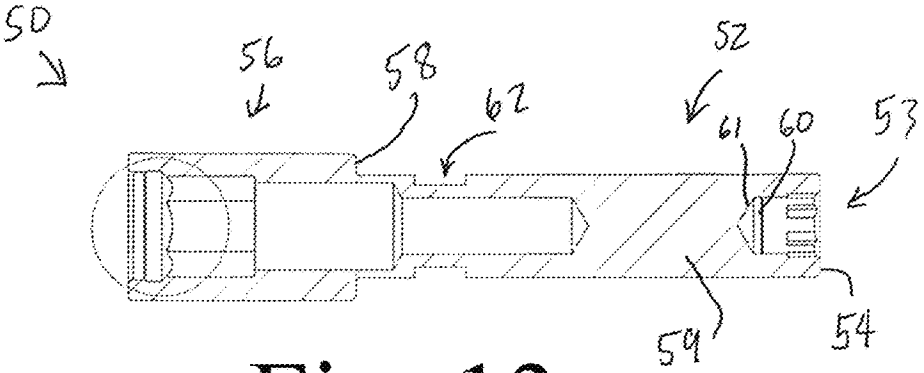
FIG. 13 is a section view taken along line 13-13 of FIG. 14.
Figure 12:
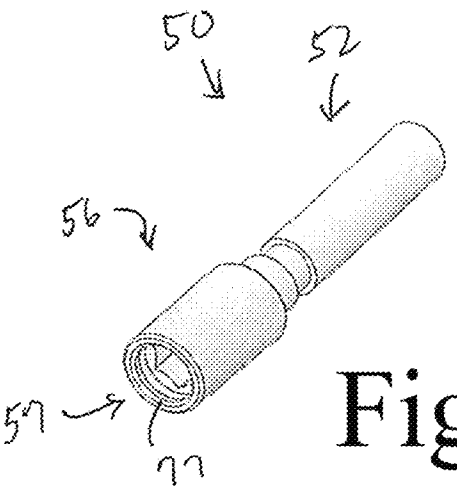
FIG. 12 is a perspective view of a component in accordance with one aspect of the tool of FIG. 7.
Figure 15:
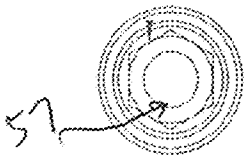
FIG. 15 is an end view of the component of FIG. 12.

FIG. 9, FIG. 10 and FIG. 11 depict sleeve 40 having a cylindrical body 42 with a hollow inside diameter portion 43. In one aspect socket 46 includes an internal spline region 44 which is located at an outward end of sleeve 40. Spline region 44 is configured to match a splined shoulder 27 of fastener 20. In one aspect splined region 44 includes splines 45 and/or spline grooves 45*a*, 45*a*. Splines 45 are formed on the inner side of body 42. In one aspect the internal spline region 44 includes multiple, separate splined grooves 45*a*, each groove defining a point 45*b*, the points 45*a* separated from each other along a circular arc of less than 90 degrees. In one aspect the points 45*a* are separated from each other along a circular arc of 30 degrees as shown in FIG. 11. In one aspect, four separate spline grooves 45*a* include points 45*b*, where the separation between the point 45*b* of the first spline groove 45*a* and the point 45*b* of the fourth spine groove 45*a* is 90 degrees. In one aspect as shown in FIG. 11, a set of 12 spline points 45*b* and associated spline grooves 45*a* are presented. These splines 45*a* are configured to match with and receive the splined shoulder 27 of fastener 20, which fastener 20 includes corresponding or matching external splines. In one aspect the pattern of socket 46 is a 0.625 12-point spline arrangement, with 0.130 deep spline grooves 45*a* measured from terminal end of sleeve 40. In one aspect, outer diameter "d" of sleeve 40 measures 0.850 inches and having a sleeve length of 2.85 inches. While a different number of separate splined grooves 45*a* may be used for internal spline region 44, use of 12 equally spaced splined grooves 45*a* is important for making sure tool 30 operates with a FAB-LOK type of fastener having a corresponding 12-popint externally splined shoulder 27. In further aspects, the socket 46 of sleeve includes a 12-sided socket without spline grooves 45*a*, and is instead a 12-sided internal socket configured to receive a 12 sided shoulder 27 of a fastener. The points 45*b* of a non-splined socket 46 may also be separated from each other along a circular arc of 30 degrees. Spline grooves 45*a* need not always be included in socket 46 in order to effectively achieve a shoulder-holding capability. In one aspect, the 12-sided internal socket comprises 12 connecting internal wall structures. In other aspect, a different number of sides are used for socket 46 to mate with a shoulder 27 having a corresponding number of sides and structure.

In one aspect it is important that the length of sleeve 40 be at least two times the measurement of its diameter "d" in order for tool 30 to function best in securing components 17, such as securing fasteners 20 within struts 13 or other components. For instance, a sleeve having such ratio or configuration allows for insertion of the sleeve 40 into an opening 15 of a strut 13 or other component while also having handle 80 positioned sufficiently outside of the opening 15 for operation. This allows a worker to sufficiently hold in place the shoulder 27 of fastener by holding the handle 80, while simultaneously spinning the head 23 positioned within opening 15. Such dimension of the length being at least two times the measurement of the diameter provides the ability to have the sleeve 40 insert within a strut 13 while also being able to hold the sleeve 40 in relative position. This avoids the need to insert a box wrench or use a vice grip or other tool in an attempt to secure the shoulder 27 which is positioned internal the opening 15 of a strut 13 or other component. Were the length of sleeve 40 not at least twice its diameter (or where the handle 80 is not set back at least 1⅝ inches from terminal end of sleeve 40), tool 30 would not be able to be positioned, for instance, in a 1⅝ inch Unistrut so that the terminal end of sleeve 40 fully touches the inside bottom portion of strut 13 while handle 80 maintains clearance from strut 13.

FIG. 12, FIG. 13, FIG. 14 and FIG. 15 depict drive shaft 50 having a driving portion 52 and a driven portion 56. Driving portion 52 includes a socket 53 which is configured to rotate the threaded component 22 of fastener 20. Particularly, socket 53 engages with head 23 to rotate the threaded shank of fastener 20. In one aspect socket 53 is a 3/16 inch female hex socket to receive a 3/16 inch hex head of fastener 20. The driving portion 52 is positioned with the hollow inside diameter portion 43 of sleeve 40. The driven portion 56 is configured to be driven by arbor 70. The driven portion 56 also includes a socket 57 to receive the arbor 70. In one aspect socket 57 is a ⅜ inch female hex socket to receive a ⅜ inch hex shaft or head of arbor 70. In one aspect, socket 53 includes a hex arrangement with six hex points 53*a* positioned internally. The hex points 53*a* may also be part of splined grooves positioned in a hex arrangement and configured to mate with a hex head 23. It may be appreciated that corresponding metric units may be used in addition to or as alternatives to the stated measurements herein.

In one aspect driven portion 56 includes a shaft elbow 58 which abuts against a terminal end 49 of sleeve 40 when the drive shaft 50 is inserted into the sleeve 40. A maximum diameter of driven portion 56 is greater than a maximum diameter of driving portion 52. The driven portion 52 has a maximum outer diameter which is greater than the inside diameter portion of the sleeve 40. In one aspect, an entirety of a terminal end 54 of the driving portion 52 is visible when the drive shaft 50 is positioned within sleeve 40 (See also FIG. 7). For instance, when viewing the drive shaft 50 at the end where socket 53 is located, an entirety of the terminal end 54 of driving portion 52 will be visible. There are no portions of sleeve 40 which obscure or cover the terminal end 54. In further aspects, an entirety of the hollow inside diameter portion 43 is greater than the outer diameter of the driving portion 52. This allows the driving portion 52 to slide freely to or toward spline region 44.

In one aspect driving portion 52 includes a solid cross-section area 59. The solid area 59 provides structural integrity for shaft 50, and also presents a shelf 61 for securing a magnet 60 within socket 53. Magnet 60 is inset from terminal end 54 of the driving portion 52. The magnet 60 is positioned, or its position is selectively altered, to impart a magnetic force upon the hex head 23 of the fastener 20. Such magnet 60 allows a user to conveniently insert and hold a fastener 20 within tool 30 while in operation. In one aspect, driving portion 52 has a length extending from shaft elbow 58 to terminal end 54 of 2.750 inches (while sleeve 40 has a total length of 2.85 inches). Other sizes may be used, provided terminal end 54 is positioned at or closely adjacent to internal spline region 44 of sleeve 40. This positioning is important so that the socket 53 may receive head 23 of fastener 20 while spline region 44 simultaneously receives shoulder 27 of fastener 20, particularly where the head 23 and shoulder 27 are arranged in close proximity (or abut each other) as in a FAB-LOK type of fastener 20.

Drive shaft 50 also includes a neck 62 which provides a clearance for receipt of prongs 82 of handle 80 when prongs 82 are inserted into handle ports 48 of sleeve 40. The prongs 82 lock drive shaft 50 within sleeve 40 so shaft 50 cannot be removed easily. Handle 80 is tong shaped and flexible to allow the ends of handle to spread apart and thus allow retraction (or insertion) of prongs 82 into handle ports 48.

Figure 16:
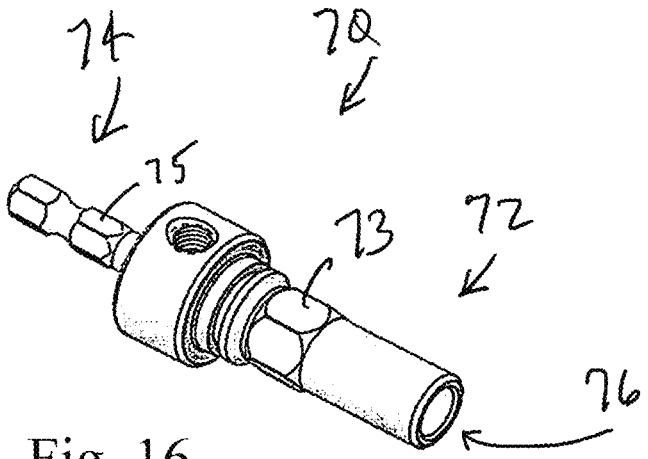
FIG. 16 is a perspective view of a component in accordance with one aspect of the tool of FIG. 7.
Figure 17:
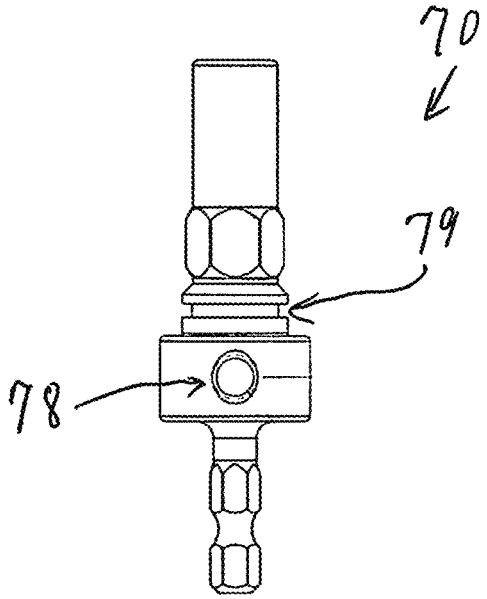
FIG. 17 is a side view of the component of FIG. 16.

FIG. 16 and FIG. 17 depict arbor 70 having a first shaft portion 72 and second shaft portion 74. First shaft portion 72 is configured to engage with the driven portion 56 of drive shaft 50 and the second shaft portion 74 is configured to connect to a drill 10 or other turning tool such as a nut driver to drive the drive shaft 50. In one aspect first shaft portion 72 includes a hex-shaped shaft aspect 73 which secures into the corresponding hex shaped socket 57 of drive shaft 50. In one aspect second shaft portion 74 includes a hex shaped aspect 75 to be inserted into a chuck or other component of a drill 10 or other tool. Hex aspect 73 in one case is a ⅝ inch hex. A double aspect 75 may also be included for insertion into a nut driver. The hex aspect 75 may include a 5/16 inch hex or even a larger hex size (⅝ inch or larger) to accommodate more secure insertion into a chuck of a drill or screwdriver tool. Arbor 70 includes a cavity 76 to receive an optional drill bit 90. Cavity 76 may be cylindrical or other configuration. A port is defined within arbor 70 and configured to receive a set-screw to secure a drill bit 90 into cavity 76. Drill bit 90 is handy to have for efficient use of tool 30 when switching between a hole-drilling mode and a fastener install mode. A relief 79 is included to receive a flexible O-ring 79' upon arbor 70. O-ring 79' friction-fits within socket 57 of drive shaft. Drive shaft 57 includes a corresponding rim 77 which projects inward from inner wall of socket 57 to provide a slight rim to receive and friction-fit O-ring 79' to allow selective insertion and retraction of arbor 70 from drive shaft 50.

Figure 18:
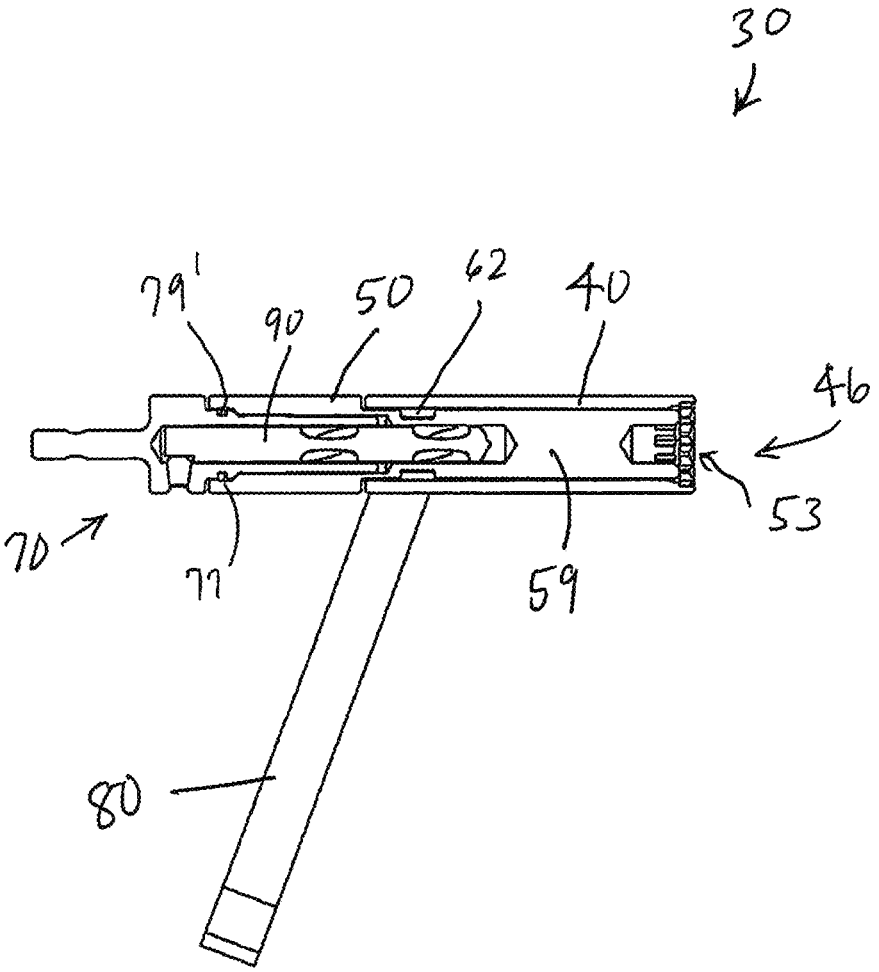
FIG. 18 is a section view taken along a longitudinal axis of the tool of FIG. 7.

FIG. 18 is a section view of tool 30 showing arbor 70 having a drill bit 90 inserted into drive shaft 50 which drive shaft 50 inserted into sleeve 40. Handle 80 is available for convenient holding and relative stabilization of sleeve 40 while the user spins arbor 70 with a drill driver or other tool. When access is desired to utilize the drill bit 90, the arbor is conveniently removed from the drive shaft with a pulling force to overcome the friction-fit caused by the O-ring within the drive shaft socket 57. An alternative detent or detent ball may be utilized instead of an O-ring, where a ball may be positioned in the wall of the drive shaft and retained in position by use of an exterior elastic band to apply pressure to the ball and prevent the ball from escape while applying elastic pressure and friction-fit for the ball press inward and to retain arbor 70 within socket 57.

Tool 30 is configured to conveniently fit within the opening 15 of a strut 13 in order to easily secure strut 13 to a panel 18. The external diameter of sleeve 40 is no greater than ⅞ inches and allows for convenient insertion into a standard 1⅝ inch strut. Sleeve 40 also has a length no less than 1⅝ inches so handle 80 may still hold sleeve 40 while a terminal end of sleeve may rest against an inside portion of the strut 13. Such length and width dimension of sleeve 40 and tool 30 allows for ease of insertion of a fastener 20 into strut 13 without having to use a separate box wrench, vice grips or other tool to hold shoulder 27 of the fastener. A user will conveniently utilize the drill bit 90 of the tool 30 and swiftly switch to include the combined drive shaft 50 and sleeve 40 which are connected with handle 80.

Shaft elbow 58 of drive shaft 50 is positioned upon the drive shaft a critical distance from terminal end 54 and in relation to the length of sleeve 40 so that when shaft 50 is fully inserted into sleeve 40, the socket 53 is positioned to receive head 23 while shoulder 27 is simultaneously engaged by socket 46. In one aspect, shaft elbow 58 is positioned 2.750 inches from end 54 while sleeve 40 has a total length of 2.85 inches. The length of sleeve 40 is at least twice the diameter of sleeve 40 to accommodate having a sufficiently narrow profile and sufficient length to secure fasteners 20 within a 1⅝ inch strut 13. The narrow profile and long length also allow for tool 30 to easily secure fasteners within other difficult to access locations, such as when fastening conduit pipe clamps or the like. In one aspect neck 62 has an outer diameter of 0.470 inches which provides clearance to receive prongs 82 to secure drive shaft 50 within sleeve 40.

In a further method aspect, the invention includes utilizing a tool 30 to secure a fastener 20 to a panel. The method includes positioning the socket 46 of sleeve 40 upon the shoulder 27 of fastener 20, simultaneously positioning the socket 53 of drive shaft 50 upon head 23 of the fastener, and turning the head 23 while holding the shoulder 27 in a relatively fixed position. The turning action causes sleeves 26 of the fastener 20 to mushroom and secure the fastener to a panel 18. In aspects, the turning is accomplished using a screwdriver, drill or drill driver, and the holding is accomplished by grasping handle 80 and resisting turning of sleeve 40. A further method includes positioning the sleeve 40 within an opening of a strut 13 and utilizing the method securing steps noted herein. In further aspects the invention includes systems where the tool 30 in conjunction with a fastener 20 is used to secure fastener 20 by operation as noted.

It should be understood, of course, that the foregoing relates to exemplary embodiments of the invention and that modifications may be made without departing from the spirit and scope of the invention as set forth in the following claims.

What is claimed is:

1. An installation tool for use with an expandable fastener including a threaded component, having a head, and a mushrooming component, having a splined shoulder, the tool comprising:

a sleeve comprising a body including a terminal end, an outward end, a hollow portion extending from the terminal end to the outward end, and an internal spline region at the outward end of the sleeve, the internal spline region configured to match the splined shoulder of the mushrooming component;

a drive shaft comprising a first end and a second end, the drive shaft extending from the first end to the second end and defining a driving portion and a driven portion, the driving portion within and extending through the hollow portion from the first end proximate to the internal spline region at the outward end of the sleeve to the terminal end of the sleeve and the driven portion external of the sleeve and extending outward from the terminal end of the sleeve and the driving portion to the second end, the driving portion mounted rotatably within the hollow portion, the driven portion configured to be driven and the driving portion solid along a solid area between the terminal end of the sleeve and a socket in the first end;

a cavity extending into the driven portion through the second end and into the driving portion from the driven portion and the terminal end of the sleeve to the solid area;

the solid area solid in diametric cross section and extending from the cavity to the socket in the first end proximate to the internal spline region at the outward end of the sleeve, the socket configured to receive and engage to the head and to rotate the threaded component in response to rotation of the drive shaft when the head is received and engaged by the socket, and the solid area dividing the cavity from the socket and providing structural integrity for the driving portion within the hollow portion from the cavity to the socket;

a drill bit secured to and extending from an arbor configured to engage to the driven portion drivenly; and the cavity configured to receive the drill bit and the arbor through the second end when the arbor is engaged to the driven portion drivenly, wherein the arbor extends into the cavity in the driven portion through the second end and the drill bit extends into the cavity in the driving portion from the arbor when the arbor is engaged to the driven portion drivenly.

2. The tool of claim 1, wherein the internal spline region includes multiple, separate splined grooves each defining a point, the points separated from each other along a circular arc of less than 90 degrees.

3. The tool of claim 1, wherein the internal spline region includes 12 splined grooves.

4. The tool of claim 1, wherein the socket comprises a hex socket.

5. The tool of claim 1, wherein the first end of the driving portion of the drive shaft is visible at the outward end of the sleeve.

6. The tool of claim 1, wherein the socket comprises a hex socket, and the cavity includes a female hex socket configured to receive the arbor.

7. The tool of claim 1, further comprising a magnet in the socket.

8. The tool of claim 1, further comprising:

the arbor engaged to the driven portion drivenly, the arbor extending into the cavity in the driven portion through the second end and the drill bit extending into the cavity in the driving portion from the arbor.

9. The tool of claim 1, wherein the sleeve has a maximum length and a maximum diameter, the maximum length is greater than twice the maximum diameter.

10. The tool of claim 1, wherein an outermost diameter of the drive shaft and an outermost diameter of the sleeve are equal.

11. A system to install an expandable fastener with the tool of claim 1, the system comprising:

the tool of claim 1; and the expandable fastener including a threaded component having a head and a mushrooming component having a splined shoulder, wherein the splined shoulder comprises a 12-point externally splined shoulder complementary to the internal spline region of the tool.

12. An installation tool for use with an expandable fastener including a threaded component, having a head, and a mushrooming component, having a splined shoulder, the tool comprising:

a sleeve comprising a body including a terminal end, an outward end, a hollow portion extending from the terminal end to the outward end, and an internal spline region at the outward end of the sleeve, the internal spline region configured to match the splined shoulder of the mushrooming component;

a drive shaft comprising a first end and a second end, the drive shaft extending from the first end to the second end and defining a driving portion and a driven portion, the driving portion within and extending through the hollow portion from the first end proximate to the internal spline region at the outward end of the sleeve to the terminal end of the sleeve and the driven portion external of the sleeve and extending outward from the terminal end of the sleeve and the driving portion to the second end, the driving portion mounted rotatably within the hollow portion, the driven portion configured to be driven and to abut the terminal end of the sleeve during installation of the expandable fastener and the driving portion solid along a solid area between the terminal end of the sleeve and a socket in the first end;

a cavity extending into the driven portion through the second end and into the driving portion from the driven portion and the terminal end of the sleeve to the solid area;

the solid area solid in diametric cross section and extending from the cavity to the socket in the first end proximate to the internal spline region at the outward end of the sleeve, the socket configured to receive and engage to the head and to rotate the threaded component in response to rotation of the drive shaft when the head is received and engaged by the socket, and the solid area dividing the cavity from the socket and providing structural integrity for the driving portion within the hollow portion from the cavity to the socket;

a drill bit secured to and extending from an arbor configured to engage to the driven portion drivenly and secure to a drill or nut driver; and the cavity configured to receive the arbor through the second end when the arbor is engaged to the driven portion drivenly, wherein the arbor extends into the cavity in the driven portion through the second end and the drill bit extends into the cavity in the driving portion from the arbor when the arbor is engaged to the driven portion drivenly.

13. The tool of claim 12, further comprising the spline region configured to match the splined shoulder having a 5/8 inch 12-point splined holding surface and where the sleeve has a length no less than 1 5/8 inches and an external diameter no greater than 7/8 inch.

14. A method of installing an expandable fastener with the tool of claim 13, wherein the expandable fastener comprises a threaded component having a head and a mushrooming component having a splined shoulder, the method comprising:

collapsing the mushrooming component by holding the splined shoulder of the expandable fastener with the internal spline region of the tool while turning the head that is engaged with the socket.

15. An installation tool for use with an expandable fastener including a threaded component, having a head, and a mushrooming component, having a shoulder, the tool comprising:

a sleeve comprising a body including a terminal end, an outward end, a hollow inside diameter portion extending from the terminal end to the outward end, and a first socket at the outward end of the sleeve, the first socket configured to match the shoulder of the mushrooming component, portions of the first socket having an internal diameter greater than an internal diameter of the hollow inside diameter portion;

a drive shaft comprising a first end and a second end, the drive shaft extending from the first end to the second end and defining a driving portion and a driven portion, the driving portion within and extending through the hollow inside diameter portion from the first end proximate to the first socket at the outward end of the sleeve to the terminal end of the sleeve and the driven portion external of the sleeve and extending outward from the terminal end of the sleeve and the driving portion to the second end, the driving portion mounted rotatably within the hollow inside diameter portion, the driven portion configured to be driven and the driving portion solid along a solid area between the terminal end of the sleeve and a socket in the first end;

a cavity extending into the driven portion through the second end and into the driving portion from the driven portion and the terminal end of the sleeve to the solid area;

the solid area solid in diametric cross section and extending from the cavity to the socket in the first end proximate to the first socket at the outward end of the sleeve, the socket configured to receive and engage to the head and to rotate the threaded component in response to rotation of the drive shaft when the head is received and engaged by the socket, and the solid area dividing the cavity from the socket and providing structural integrity for the driving portion within the hollow inside diameter portion from the cavity to the socket;

a drill bit secured to and extending from an arbor configured to engage to the driven portion drivenly and secure to a drill or nut driver; and the cavity configured to receive the drill bit and the arbor through the second end when the arbor is engaged to the driven portion drivenly, wherein the arbor extends into the cavity in the driven portion through the second end and the drill bit extends into the cavity in the driving portion from the arbor when the arbor is engaged to the driven portion drivenly.

16. The tool of claim 15, wherein the driven portion defines a shaft elbow which abuts against the terminal end of the sleeve when the drive shaft is inserted into the sleeve and while the sleeve is held into position during installation of the expandable fastener.

17. The tool of claim 15, the head comprising a 5/16 head, the shoulder comprising a 12-point shoulder, the socket comprising a 5/16 inch hex-head socket, and the first socket comprising a 12-point socket.

18. The tool of claim 15, wherein the socket is defined in part by a wall of the drive shaft, the wall having an internal portion and an external cylindrical portion, the external cylindrical portion having a diameter less than a smallest hollow inside diameter of the sleeve.

19. The tool of claim 15, wherein the first end extends at least partially into the first socket.

20. An installation tool for use with an expandable fastener including a threaded component, having a head, and a mushrooming component, having a shoulder, the tool comprising:

a sleeve comprising a cylindrical body including a terminal end, an outward end, a hollow inside diameter portion extending from the terminal end to the outward end, and a first socket at the outward end of the sleeve, the first socket configured to match the shoulder of the mushrooming component;

a drive shaft comprising a first end and a second end, the drive shaft extending from the first end to the second end and defining a driving portion and a driven portion, the driving portion within and extending through the hollow inside diameter portion from the first end proximate to the first socket at the outward end of the sleeve to the driven portion external of the sleeve and extending outward from the terminal end of the sleeve and the driving portion to the second end, the driving portion mounted rotatably within the hollow inside diameter portion, the driven portion configured to be driven and the driving portion solid along a solid area between the terminal end of the sleeve and a socket in the first end;

a cavity extending into the driven portion through the second end and into the driving portion from the driven portion and the terminal end of the sleeve to the solid area;

the solid area solid in diametric cross section and extending from the cavity to the socket in the first end proximate to the first socket at the outward end of the sleeve, the socket configured to receive and engage to the head and to rotate the threaded component in response to rotation of the drive shaft when the head is received and engaged by the socket, and the solid area dividing the cavity from the socket and providing structural integrity for the driving portion within the hollow inside diameter portion from the cavity to the socket;

a drill bit secured to and extending from an arbor configured to engage to the driven portion drivenly and secure to a drill or nut driver;

the cavity configured to receive the drill bit and the arbor through the second end when the arbor is engaged to the driven portion drivenly, wherein the arbor extends into the cavity in the driven portion through the second end and the drill bit extends into the cavity in the driving portion from the arbor when the arbor is engaged to the driven portion drivenly; and a handle having a prong positioned within a handle port of the sleeve and configured to inhibit removal of the drive shaft from the sleeve.

* * * * *